United States Patent [19]

Davis

[11] Patent Number: 4,980,815

[45] Date of Patent: Dec. 25, 1990

[54] APPARATUS FOR APPLYING LANE DRESSING TO A BOWLING LANE

[75] Inventor: John M. Davis, Sebring, Fla.

[73] Assignee: The Kegel Company, Inc., Sebring, Fla.

[21] Appl. No.: 280,374

[22] Filed: Dec. 6, 1988

[51] Int. Cl.[5] ..... G05B 19/05; A47L 13/30

[52] U.S. Cl. ..... 364/140; 364/147; 364/479; 15/49.1; 134/56 R

[58] Field of Search ..... 364/140, 147, 479; 15/98, 49 R, 21 R, 98; 134/132, 56 R; 427/428; 118/207

[56] References Cited

U.S. PATENT DOCUMENTS 3,868,738 3/1975 Horst et al. ..... 15/4

4,246,674 1/1981 Ingermann et al. ..... 15/4

4,463,469 8/1984 Green ..... 15/98

4,727,615 3/1988 Kubo ..... 15/98

*Primary Examiner*—Jerry Smith

*Assistant Examiner*—Paul Gordon

*Attorney, Agent, or Firm*—Hovey, Williams, Timmons & Collins

[57] ABSTRACT

An improved apparatus for applying lane dressing to bowling lane surfaces is provided which precisely controls the desired quantity and distribution of lane dressing applied to selective treatment zones presented by the bowling lane surface. The preferred apparatus includes a plurality of activatable metering pumps which discharge discrete, predetermined quantities of lane dressing to a transfer mechanism. The transfer mechanism distributes and transfers the lane dressing quantities to selected portions of an applicator buffer roller which in turn applies the lane dressing quantities to corresponding bowling lane treatment zones.

15 Claims, 8 Drawing Sheets

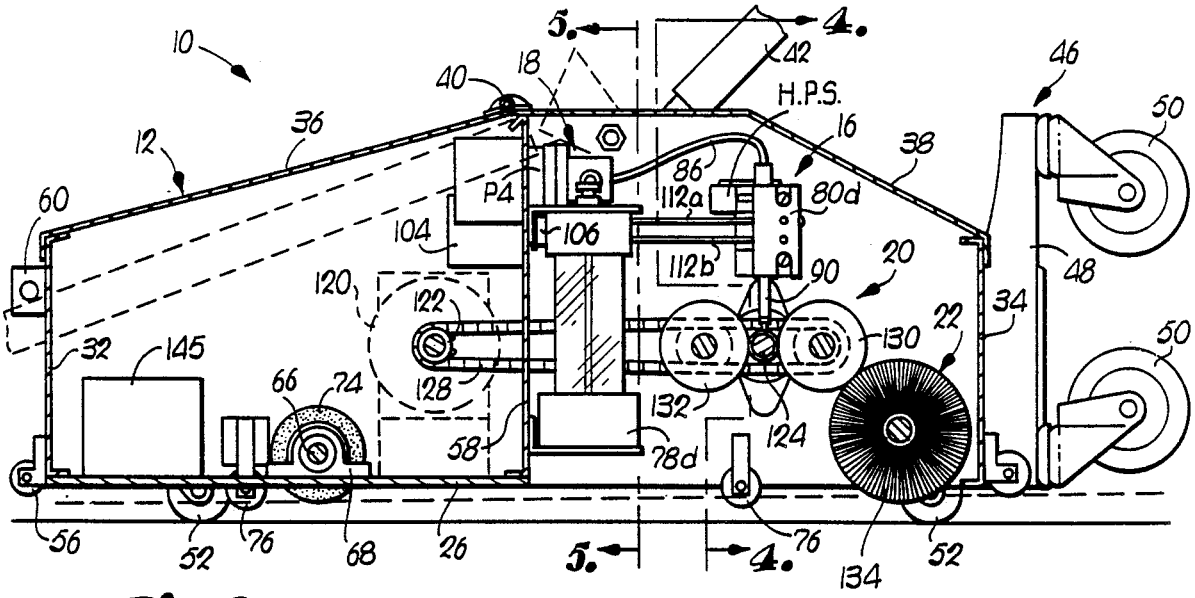
Fig.3.
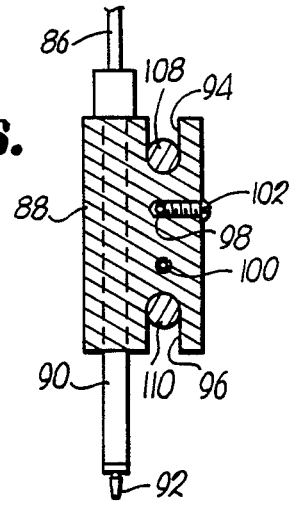
Fig.6.
Fig.1.
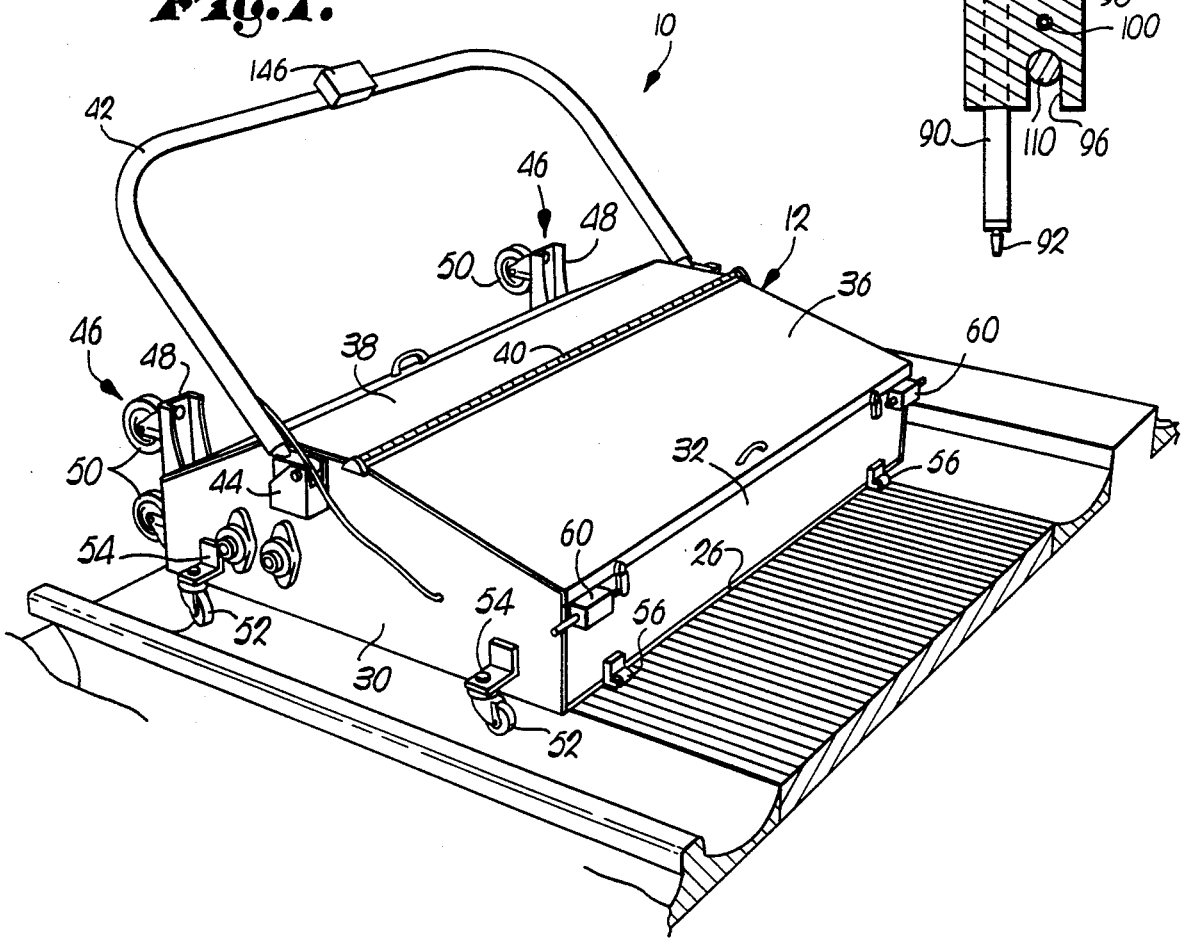

APPARATUS FOR APPLYING LANE DRESSING TO A BOWLING LANE

BACKGROUND OF THE INVENTION

1. Field of the Invention

The present invention is concerned with an improved apparatus for applying lane dressing to a bowling lane surface which precisely controls the desired quantity and distribution of the lane dressing applied to selected bowling lane treatment zones. More particularly, the preferred apparatus includes a plurality of activatable metering pumps which discharge discrete, predetermined quantities of lane dressing to a transfer mechanism which, in turn, transfers the lane dressing quantities to selected portions of an application buffer which then applies lane dressing quantities to corresponding bowling lane treatment zones.

2. Background of the Prior Art

The operators of bowling centers apply lane dressing to bowling alley lanes to prevent damage to the lane surfaces by bowling ball impact and friction and, more importantly, in an attempt to provide uniform bowling lane conditions. To encourage uniform bowling lane conditions, the American Bowling League Congress (ABC) has set forth standards for lane dressing application with which bowling centers must comply for ABC sanctions of honor scores, and league and tournament scores in that center.

One of the lane dressing standards requires that a transverse profile of the lane dressing along the entire length of the lane falls within certain limits. This standard allows a greater application of lane dressing to the center boards as opposed to the outer boards. Known prior art lane dressing devices, however, have been unable to apply lane dressing precisely enough in order to consistently comply with this standard. Such prior art equipment is illustrated in U.S. Pat. No. 3,868,738, the disclosure of which is hereby incorporated by reference.

Because of the inability of prior art equipment to satisfy this standard, bowling center operators choose to comply with a second allowable standard known as the so-called "alternative 2" rule or "limited distance dressing" rule. This second standard does not set forth a precise lane dressing profile but allows lane dressing to be applied only to the first 24 feet of the lane with the remaining distance to pins being devoid of applied lane dressing. As those skilled in the art and in the sport of bowling appreciate, application of lane dressing only to the first portion of the bowling lane allows streaks of lane dressing to form in the supposedly "dry" portion of the lane near the pins. As a result of these streaks, lane conditions near the pins become inconsistent and erratic leading to inconsistent and erratic bowling scores or scores which are higher than would normally be expected. The cause of this problem has become more apparent since the advent of lane dressing measuring equipment which precisely quantifies and graphically illustrates lane dressing profile across a transverse section of a bowling lane.

SUMMARY OF THE INVENTION

The prior art problems outlined above are solved by the improved lane dressing apparatus of the present invention. That is to say, the improved apparatus hereof precisely controls the quantities and distribution of lane dressing applied to a bowling lane surface.

Broadly speaking, the preferred apparatus includes a rotatable applicator buffer with outwardly extending, flexible brush-like members for applying lane dressing to the bowling lane surface as the apparatus is propelled therealong, a lane dressing delivery assembly for delivering lane dressing to the applicator buffer which includes at least one activatable metering pump coupled with a lane dressing reservoir for discharging a discrete, predetermined quantity of lane dressing upon each activation and a transfer mechanism for receiving and transferring the lane dressing quantity to the applicator buffer, and a control means for selectively activating the metering pump.

In the preferred embodiment, the applicator buffer includes a plurality of applicator portions which respectively correspond to a plurality of treatment zones presented by the bowling lane. The transfer mechanism includes means for transferring lane dressing quantity to a selected one of the applicator portions for subsequent application to a corresponding treatment zone. In this way, the improved apparatus precisely controls the quantity of lane dressing delivered to the the bowling lane surface and also precisely controls the placement and distribution of the lane dressing quantity on the bowling lane surface.

In particularly preferred forms, the transfer mechanism presents a plurality of transfer sections corresponding to the applicator portions. Metering pumps are provided to discharge respective lane dressing quantities to selected transfer sections for subsequent transfer to the applicator portions and application to the bowling lane treatment zones. The preferred transfer mechanism includes a cloth covered reception roller for receiving lane dressing thereon from the metering pumps, a distribution roller rollably engaged with the reception roller for transfer of lane dressing therebetween in order to distribute the lane dressing quantity along the corresponding transfer section, and a transfer roller also rollably engaged with the reception roller for transferring the lane dressing quantity to the corresponding applicator portion.

The preferred control means includes a programmable controller having a memory device for storing an operating program for operating the apparatus and for storing information representative of the quantities of lane dressing to be applied to each treatment zone. Other preferred aspects of the present invention are explained further hereinbelow.

BRIEF DESCRIPTION OF THE DRAWING FIGURES

FIG. 1 is a perspective view of the preferred apparatus showing it in operative relationship adjacent the foul line of a bowling lane;

FIG. 3 is a sectional view of the apparatus taken along line 3—3 of FIG. 2;

FIG. 6 is a sectional view of the preferred discharge head of the apparatus;

DESCRIPTION OF THE PREFERRED EMBODIMENT

Figure 2:
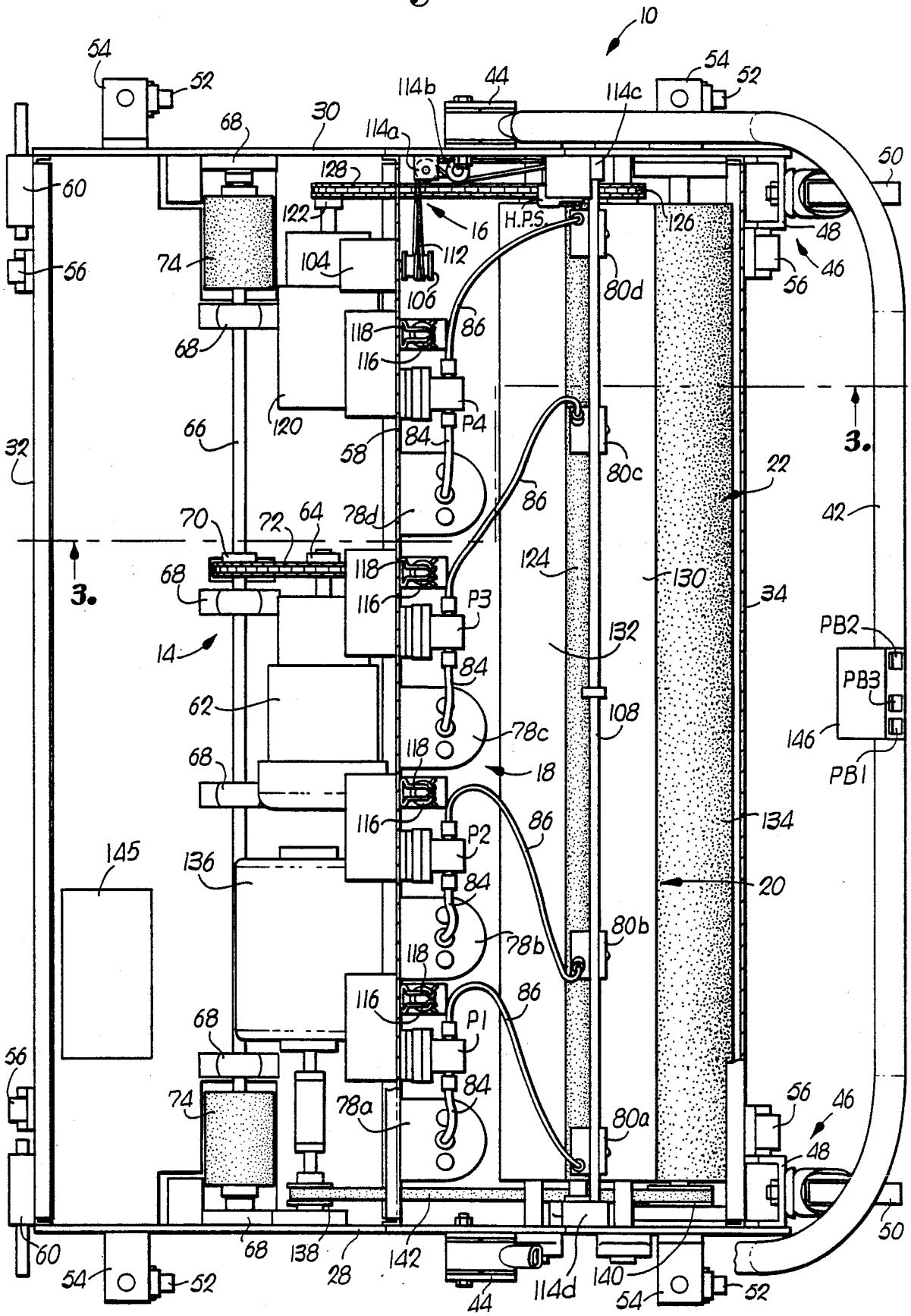
FIG. 2 is a plan view of the apparatus of FIG. 1 with the housing covers removed to the show the operative components thereof and with portions cut away for clarity of illustration.

Referring now to the drawing figures and in particular FIGS. 1-7, preferred apparatus 10 for applying lane dressing to the surface of a bowling lane broadly includes housing assembly 12, propulsion mechanism 14, lane dressing delivery group 16 including lane dressing metering assembly 18 and transfer assembly 20, applicator assembly 22, and control unit 24.

Housing assembly 12 includes bottom wall 26, left and right side panels 28 and 30, front and rear panels 32 and 34, front top cover 36 coupled with rear top cover 30 by piano-type hinge 40, and U-shaped handle 42 pivotally coupled with side panels 28, 30 by a pair of respective couplers 44.

Housing assembly 12 also includes a pair of storage and transport wheel assemblies 46 including respective channel-shaped support members 48 attached to opposed ends of rear panel 34, each having a pair of rearwardly extending, caster-type transport wheels 50 coupled therewith. Transport wheel assemblies 46 allow apparatus 10 to be supported on end by support wheels 50 for ease of movement and convenient storage. In the storage position handle 42 is pivoted forwardly to a position around side panels 28, 30 and front panel 34.

Housing assembly 12 also includes four caster-type support wheels, respective pairs of which are coupled with side panels 28, 30 by respective angle clips 54. Support wheels 52 support the body of apparatus 12 above floor level as it is moved from lane to lane so that operative portions thereof do not engage the floor.

Four support rollers 56 are also included in housing assembly 12. Respective pairs of rollers 56 are coupled to front and rear panels 32, 34 in order to provide additional support to apparatus 10 as it engages a bowling lane.

Internal, transverse dividing wall 58 (FIG. 3) provides additional internal structural support for housing assembly 12 especially for hinge 40 and covers 36, 38 and also provides structure for mounting internal components of apparatus 10. Finally, assembly 12 also includes respective top cover latches 60, pairs of which are respectively coupled to front and rear panels 32, 34 for releasably latching covers 36, 38 in place.

Propulsion mechanism 14 is enclosed within housing assembly 12 and includes drive motor 62 having drive sprocket 64 coupled to the output shaft thereof, transverse drive shaft 66 rotatably supported by spaced-apart bearings 68 and having driven sprocket 70 connected thereto, drive chain 72 interconnecting sprockets 64 and 70, and a pair of drive rollers 74 respectively coupled adjacent opposed ends of shaft 66 and extending through bottom wall 26 slightly below the surface thereof for engaging the surface of a bowling lane for propelling apparatus 10 therealong. Propulsion mechanism 14 also includes a pair of beveled guide wheels 76 respectively coupled to the inner surfaces of side panels 28, 30 adjacent the lower edges thereof for centering apparatus 10 in relation to the bowling lane.

Drive motor 62 is preferably a BISON brand, one sixth H.P., 156 R.P.M. available from W. W. Granger Company and drive rollers 74 are preferably ⅛ inches in diameter. Motor 62, sprockets 64 and 70 and drive roller 74 cooperate to propel apparatus 10 at about 25 inches per second.

Lane dressing metering assembly 18 includes lane dressing reservoirs 78*a*, *b*, *c*, and *d*, corresponding metering pumps P1, P2, P3, and P4, discharge heads 80*a*, 80*b*, 80*c*, and 80*d*, and head shifting assembly 82. Reservoirs 78*a–d* are conventional in nature and are designed to store a supply of lane dressing therein. The preferred reservoirs include a transparent housing for viewing the level of lane dressing therein and also respective low oil switches which are discussed further in connection with control unit 24. Reservoirs 78*a–d* are preferably mounted to dividing wall 58 in an upright orientation.

Metering pumps P1–P4 are also mounted to dividing wall 58 and are preferably Lab Pump Junior Model RH available from Fluid Metering, Inc. of Oyster Bay, N.Y. Four supply tubes 84 respectively connect the suction ports of pumps P1–P4 with a respective corresponding reservoir 78*a–d* . Four discharge tubes 86 respectively connect the discharge ports of pumps P1–P4 with a respective corresponding discharge heads 80*a–d*.

Discharge heads 80*a–d* each include mounting block 88 and a tubular liquid dressing discharge "pencil" 90 removably received in a generally upright configuration through mounting block 88 with the upper end thereof connected to a respective discharge tube 86, and with the lower end thereof presenting discharge tip 92 through which lane dressing is discharged. Mounting block 88 presents an upper, U-shaped in cross section, guide slot 94 which opens upwardly from the upper surface thereof, and a similarly configured lower guide slot 96 which opens downwardly as shown in FIG. 6. Each mounting block 88*a–d* also presents upper and lower, transverse, cable passageways 98 and 100 arranged one above the other as shown in FIG. 6. Set screw 102 is threadably received through the forward side of each mounting block in order to engage and hold one of the cable portions received through passageways 98, 100 as explained further in connection with transfer assembly 20. Mounting blocks 88 are preferably composed of machined ultra high molecular synthetic resin material or nylon to present low friction surfaces as an aid in lateral shifting thereof.

Head shifting assembly 82 includes reversible synchronous head motor 104 mounted to the forward side of dividing wall 58 having an output shaft extending rearwardly through wall 58 with drive pulley 106 connected thereto, transverse tubular guide and support rails 108 and 110 transversely mounted within housing assembly 12 rearwardly of dividing wall 58, continuous drive cable 112 presenting upper and lower cable portions 112*a* and 112*b*, and four sets of cable idler pulleys 114*a*, *b*, *c*, and *d*. Guide and support rails 108, 110 are respectively received within upper and lower guide slots 94, 96 of each mounting block 88 for transverse shiftable mounting.

Figure 4:
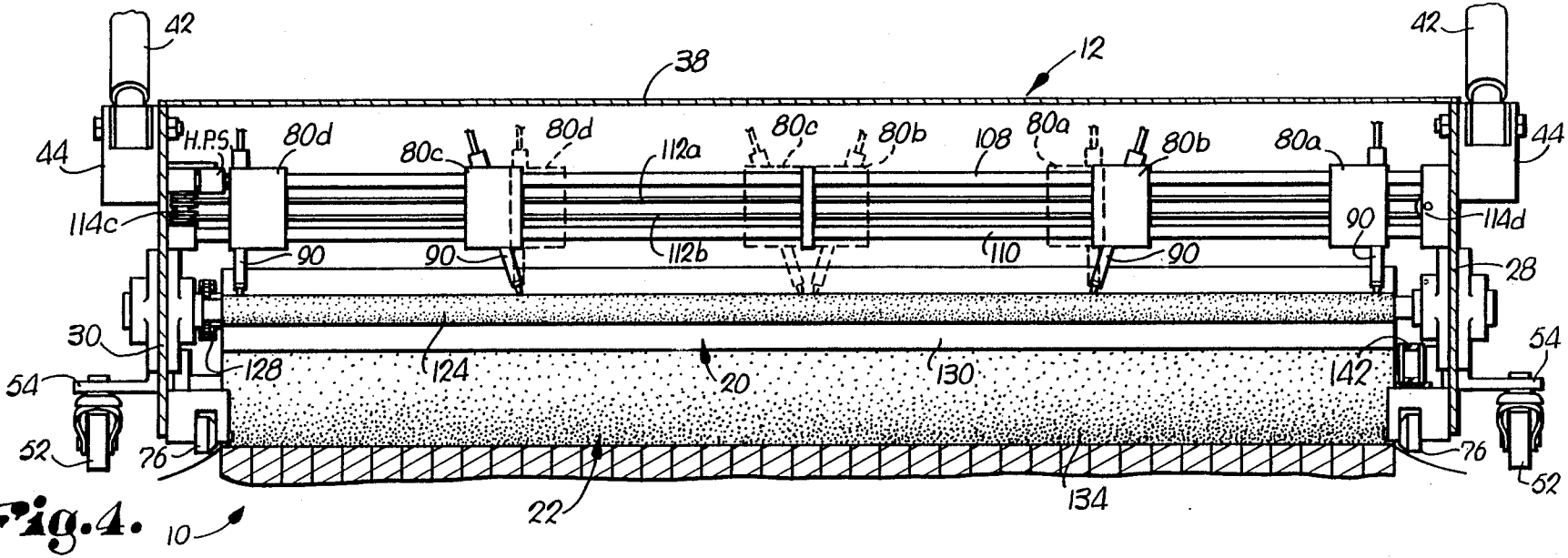
FIG. 4 is a partial sectional view of the apparatus taken along line 4—4 of FIG. 3 showing the apparatus in operative relationship with a bowling lane.

Cable 112 is wrapped about drive pulley 106 and extends around cable idler pulleys 114*a–d* in order to present upper and lower cable portions 114*a*, *b* one above the other for respective extension through upper and lower cable passageways 98 and 100 defined in each mounting block 88. Respective set screws 102 of discharge heads 80*a*, *b* set upper cable portion 112*a* in upper cable passageway 98. Respective set screws 102 for discharge heads 80*c*, *d* set lower cable portion 112*b* in lower cable passageways 100. In this way, forward operation of head motor 104 (counterclockwise as viewed in FIG. 5) causes upper cable portion 112*a* to shift leftwardly and lower cable portion 112*b* to shift rightwardly as viewed in FIG. 4. With these respective motions, discharge heads 80*a–d* move from their respective "home" positions as shown in FIG. 4 toward the center line of apparatus 10 to the remote position as shown in phantom lines in FIG. 4. Similarly, reverse action on head motor 104 (clockwise as viewed in FIG. 5) shifts cable portions 112*a*, *b* away from the center in order to shift heads 80*a–d* outwardly toward the "home" position.

Figure 5:
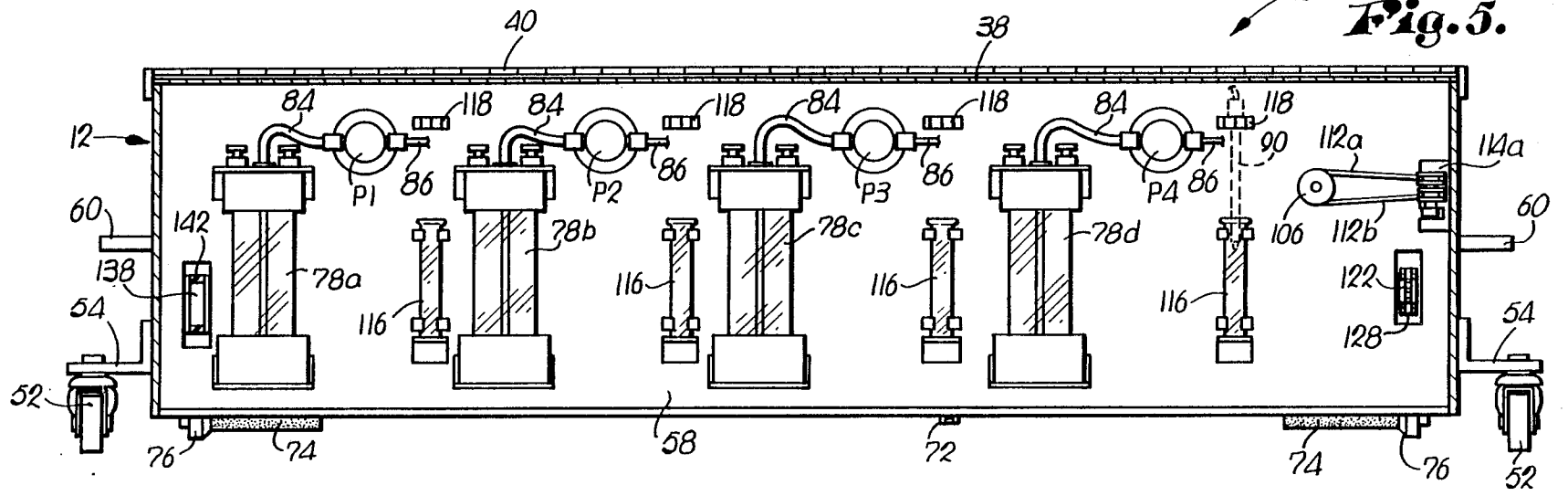
FIG. 5 is a sectional view taken along line 5–5 of FIG. 3.

Cable idler pulley sets 114*a*, *b*, and *c* each present a pair of idler pulleys mounted for coaxial rotation about an upright axis. Cable idler set 114*d* presents a single idler pulley mounted for rotation about a horizontal axis as shown in FIG. 5.

Metering assembly 18 also includes four graduated cylinders or graduates 116 mounted to dividing wall 58 adjacent and slightly below respective metering pumps P1–P4. Graduates 116 are provided for test measurements of each pump. In order to do so, a discharge pencil is removed from its associated mounting block and placed in position to discharge lane dressing into the corresponding graduate 116. As shown in FIG. 5, a pencil mounting clip 118 is provided above each graduate 116 in order to mount a respective discharge pencil during volume testing and measurement.

Transfer assembly 20 includes transfer motor 120 having drive sprocket 122 coupled to the output shaft thereof, reception roller 124 transversely mounted within housing assembly 12 directly below and aligned with rails 108 and 110 and with discharge pencils 90 and have driven sprocket 124 coupled at the rightward end thereof, drive chain 126 intercoupling sprockets 122, 124, transfer roller 130 transversely mounted within housing assembly 12 rollably engaged with reception roller 124 on the rearward side thereof, and distribution roller 132 constructed the same as transfer roller 130 but mounted on the opposed side and rollably engaged with reception roller 124 as best viewed in FIG. 3.

Transfer motor 120 is preferably a BISON model PSC one-fifteenth horsepower motor from W. W. Granger Company and provides an output at 97 rpm. Reception roller 124 is preferably a ¾-inch diameter steel roller covered with a lane dressing absorbent cloth material such as that known as BRUSH available from Collins and Aikman of Rocksborough, N.C. Transfer and distribution rollers 130, 132 are preferably 2½-inches in diameter and composed of steel.

Applicator assembly 22 includes cylindrical applicator buffer 134 transversely mounted within housing assembly 12 by conventional bearings for dressing-transfer contact with transfer roller 130, buffer motor 136 having drive sheave 138 coupled with the output shaft thereof, driven sheave 140 coupled to the leftward end of buffer 134, and drive V-belt 142 intercoupling sheaves 138 and 140.

Applicator buffer 134 is preferably 4½ inches in diameter and composed of synthetic resin material. A plurality of bristles 144 are coupled with the periphery of buffer roller 134 to present a brush-like configuration.

Bristles 144 are preferably composed of a synthetic resin material known as PEX available from Collins and Aikman of Rocksborough, N.C. Each bristle 144 is approximately 0.014 inches diameter and 3½-inches long. Bristles 144 are then folded over with the ends thereof connected to the periphery of buffer roller 134 and with the distal portion presenting a "fold" and extending outwardly about 1.75 inches. Buffer roller 134 is preferably mounted to present a "wipe" of approximately ½-inch with transfer roller 130 and a similar ½-inch wipe with the surface of a bowling lane when apparatus 10 is so engaged. The selection of buffer motor 136 and sheaves 138, 140 are designed to rotate the buffer roller at approximately 1100 RPM in a clockwise direction as viewed in FIG. 3. This provides a slight rearward force on apparatus 10 during operation and acts as a brake when propulsion mechanism 14 is deactivated. At the preferred RPM, the resulting centrifugal force tends to move the lane dressing on bristles 144 outwardly for subsequent application to the bowling lane.

Figure 8:
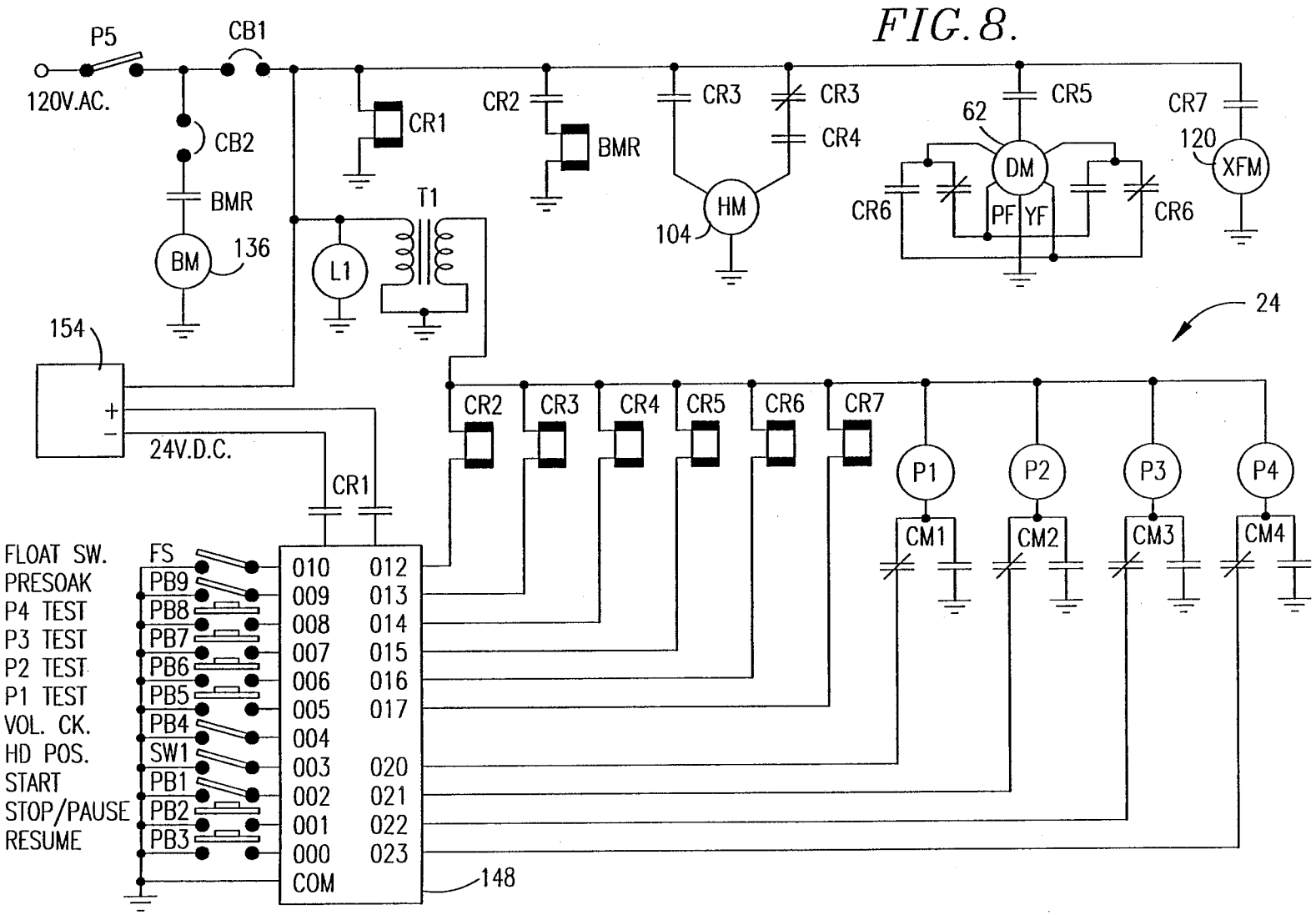
FIG. 8 is an electrical schematic of the preferred electrical control unit including a programmable controller.

FIG. 8 is an electrical schematic diagram illustrating control unit 24 which includes the electrical components for apparatus 10. Control unit 24 is contained in a conventional electrical housing 145 with a conventional power cord designed to couple with standard 120 V.A.C. supply power.

As illustrated in FIG. 8, control unit 24 is connected to pumps 1–4, drive motor 62, head motor 104, transfer motor 120, and buffer motor 136. Remote switch assembly 146 is connected to handle 42 at a convenient location thereon and electrically coupled with the components in housing 145. Switch assembly 146 includes normally open, start switch PB1, normally open, stop/-pause push-button PB2, and normally open, push button, resume switch PB3.

The balance of the switches included in control assembly 24 are mounted on electrical housing 145 within housing assembly 12 as these switches are not as frequently used. These additional switches include normally open volume check switch PB4, normally open, pump test push-buttons PB5, PB6, PB7, and PB8, normally open, pre-soak switch PB9, and normally open head motor reset switch SW1.

Control assembly, 24 is also connected to respective normally open float switches FS1, 2, 3, and 4 for each reservoir 78*a–d* and normally open head position switch HPS which is activated to the closed position when discharge head 80*d* is in the beginning or "home" position as best viewed in FIGS. 2 and 4. Control assembly 24 also includes within housing assembly 12, power switch PS, 8 amp. circuit breaker B1, 15 amp. circuit breaker B2, and pilot light L1.

Programmable controller 148 (Omron Sysmac Type S-6) is preferred to provide the primary control functions for control assembly 24. As is conventional, the program for such controller is illustrated in the format of a so-called "ladder" diagram which is a specialized form of software notation. As those skilled in the art will appreciate, and as the ladder diagrams of FIGS. 9A–13 illustrate, these control functions could also be performed by conventional electromechanical relays, solid state relays, timers, counters, and so forth, or by a conventional microprocessor with appropriate software, for example.

In use, lane maintenance apparatus 10 is first placed in operative relationship with a bowling lane as illustrated in FIGS. 1, 3, and 4. The rearward end of apparatus 10 is placed adjacent the bowling lane foul line whereupon wheels 52 rest within the adjacent gutters, rollers 56 support the bulk of the weight of apparatus 10, drive rollers 74 engage the bowling lane, guide rollers 76 engage the outboard corners thereof to center apparatus on the lane, and bristles 144 of applicator buffer roller 134 engage the surface of the lane.

Once in place, the operator checks the supply of lane dressing in reservoirs 70*a–d*, and plugs the power cord into a convenient outlet. The operator then releases latches 60 in order to open front top cover 36 to gain access to activate power switch PS. This activates light L1 which the operator confirms. The operator then closes and relatches cover 36 and moves in position behind apparatus 10 and pushes start button PB1. This activates controller 148 to execute the operating program in order to activate the various motors in the programmed sequence.

Figure 7:
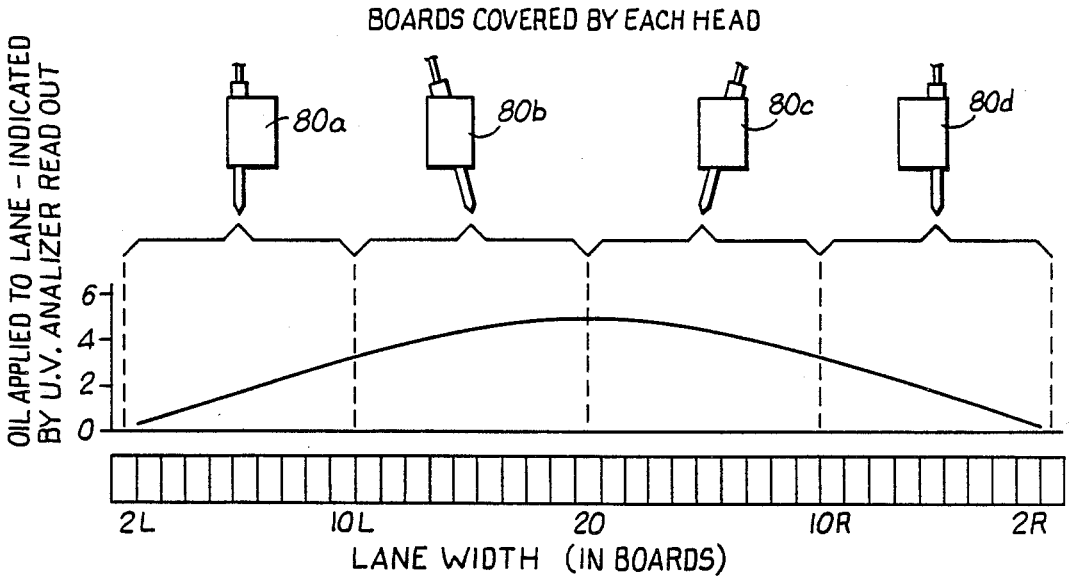
FIG. 7 is a schematic illustration of a bowling lane with a graph associated therewith illustrating the preferred transverse lane dressing profile in relationship to the lane and illustrating the relationship between the preferred discharge heads and the lane dressing profile for individual lane boards.

By way of a preliminary overview of the operation of apparatus 10, FIG. 7 presents a cross sectional representation of a standard bowling lane which is composed of 39 boards each having a width of 1 and 1/16 inches. It is preferred, however, that only the inner 37 boards receive lane dressing. In the preferred environment of use, bowling lane surface 152 presents four elongated, side-by-side treatment zones as shown in FIG. 7. Zone A includes boards 26 through 10L. Zone B includes board 11L through one-half of board 20. Zone C includes the other half of board 20 through board 11R, and Zone D includes board 10R through board 2R. Discharge heads 80*a–d* correspond respectively to zones A-D and discharge lane dressing for ultimate application to these respective zones.

When head motor 24 is activated in the forward direction, each respective discharge head 80*a–d* shifts from its home position to its remote position and thereby traverses a corresponding transfer section of transfer assembly 20. Each of the transfer sections corresponds roughly to one-fourth the length of reception roller 124, transfer roller 130, and distribution roller 132. The transfer sections in turn correspond to similarly defined applicator portions of buffer 134 which in turn correspond to treatment zones A–D.

In operation, discharge head 80*a* discharges a programmed number of discrete, predetermined quantities of lane dressing at predetermined locations onto the corresponding transfer section of reception roller 124. Distribution and transfer rollers 132, 130 further distribute these lane dressing quantities throughout the corresponding transfer section. Transfer roller 130 then transfers these lane dressing quantities to the corresponding applicator portion for subsequent application to treatment zone A as apparatus 10 traverses the length thereof. In this way, discharge heads 80*a–d* determine the amount and distribution of lane dressing applied to treatment zones A–D respectively by controlling the placement and number of lane dressing quantities discharged onto reception roller 124. FIG. 7 illustrates a transverse lane dressing profile in accordance with alternative 1 of the American Bowling Congress standards providing for a greater amount of lane dressing in the center boards, a lesser amount on the outer boards, with a gradual transistion across the width of the lane.

In order to enhance the precision and control of lane dressing application, preferred apparatus 10 is designed to produce up to 10 discharges of discrete, predetermined lane dressing quantities per board. Furthermore, each pump can be calibrated to provide a desired quantity of lane dressing during each discharge.

Turning now to the details of operation, FIGS. 9A–13 illustrate the operating program stored in the memory of controller 148 in so-called "ladder" format. In this format, the program is illustrated with symbols conventionally used to represent electromechanical relays having coils and contacts.

RUN submodule 900 (FIG. 9A) is initiated when the operator closes start switch PB1 which energizes relay KR0 through closed float switch FS and normally closed contact KR4. Activation of coil KR0 in turn activates controller output coil 013 (head motor forward), timer T0, counter RDM, and an enables most of the other coils, counters, and timers as shown in FIGS. 9A–13.

Controller output 013, when active, sinks current in order to energize electromechanical relay CR3 which in turn closes an associated contact to energize head motor 104 from the 120 V.A.C. supply (FIG. 8). With motor 104 energized, discharge heads 80*a–d* begin traversing their associated transfer sections at the rate of 1 1/16th inches per 2 seconds which corresponds to one board per 2 seconds. At this rate, the shifting of each discharge head from its home position to its remote position takes about 19 seconds.

Activation of coil KR0 also activates timer T0 through normally closed contact T1. After 0.1 seconds, timer T1 is activated through now closed contact T0. After another 0.1 second delay, timer T1 deenergizes timer T0 which in turn deenergizes and thereby resets timer T1. This sets up a 50% duty cycle pulse train with a cycle time of 0.2 seconds.

Activation of coil KR0 also activates counter RDM at terminal S thereof and enables reception of pulses from timer T0 at RDM terminal IN. Activation of coil KR0 also disables RDM counter reset terminal R by opening a normally closed KR0 contact.

Counter RDM includes input terminal F/R (forward-/reverse) receiving input from contact 080 which is not used in the preferred embodiment but must be defined for proper functioning of counter RDM.

Counter RDM also includes 32 defined contacts which can be programmed to be active for a maximum of 10 pulse counts produced by timer T0.

RDM contacts 2–10 are used to control relay coils 31 and 45 for pumps P1 and P4 respectively. That is to say, in the preferred embodiment, it is desired to have a symmetrical lane dressing profile and thus pumps P1 and P4 are designed to provide equal quantities of lane dressing. Similarly, pumps 2 and 3 are similarly controlled together to provide equal quantities of lane dressing. The program can be changed if desired, however, to provide unsymmetrical lane dressing application for ABA professional bowling, for example.

Figure 9A:
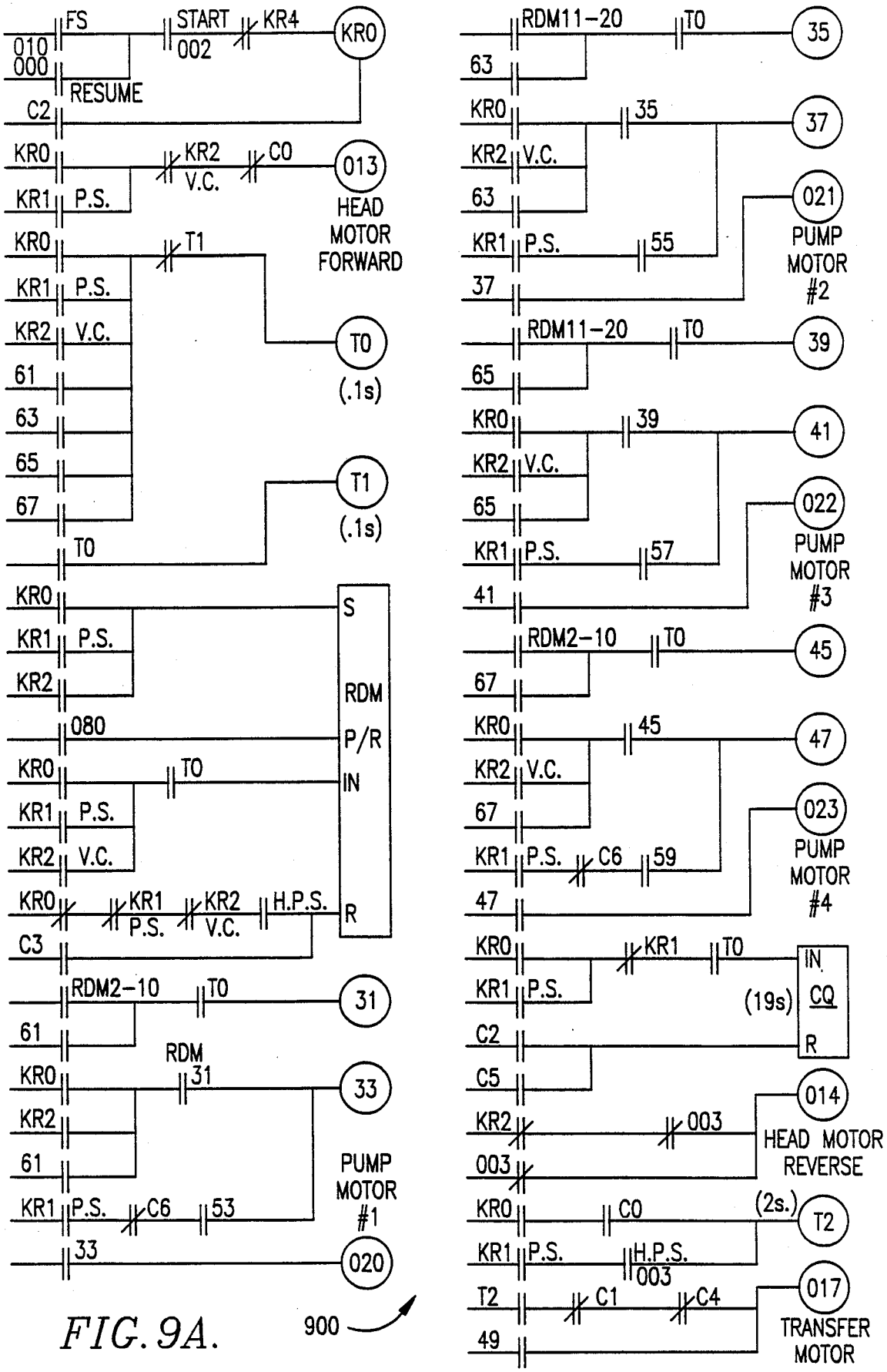
FIG. 9A is a ladder diagram illustrating a portion of the RUN submodule of the preferred operating program.

As shown in FIG. 9*a*, RDM contacts 2–10 enable coil 31 to receive pulses by way of timer contact T0. In the drawing illustration, RDM contacts 2–10 are illustrated as a single contact, but, in the actual programming, are represented by nine contacts in parallel with each being independently controlled and with each corresponding to a particular lane board.

For example, RDM contacts 2–10 correspond to boards 2 through 10 respectively and also correspond to boards 38 through 30 respectively in association with pump P4 and with coil 45. As discussed above, each head traverses a width equivalent to a board in two seconds which corresponds to ten cycles of timer T0 (0.2 seconds per cycle). Each RDM contact is configured to be active for up to ten pulse counts during the time the associated discharge head is traversing a length corresponding to its associated lane board.

For example, it may be desirable to provide a very light application of lane dressing to boards 2 and 38 as illustrated in FIG. 7. If such is the case, RDM contact 2 may be programmed to be active for only one pulse count in order to deliver one discrete quantity of oil from pump 1 during this time.

This one pulse count may be programmed to be any one of the ten counts available to RDM contact 2 corresponding to ten application locations. If pulse count 4 is chosen and programmed, RDM contact 2 closes in response to reception of the fourth pulse at terminal IN of counter RDM and opens again at the end of that pulse. With this example, relay 31 is similarly activated through RDM contact 2 and timer contact T0 for one pulse count. This in turn activates relay 33 through now closed contacts KR0 and 31.

When relay 33 is activated, it activates controller output 020 to sink current to energize pump P1 through normally closed cam contact CM1 included as part of pump P1. As pump 1 is energized, it rotates an internal cam which closes normally open contact CM1 to maintain pump P1 energized until the cam again rotates to a position to close normally closed contact CM1. This takes between 0.1 and 0.2 seconds so that by the time normally closed contact CM1 again closes, controller output 020 is no longer active to sink current, and pump 1 deenergizes. With this arrangement, an energized pump completes exactly one revolution and thereby discharges a precisely controlled, discrete, predetermined quantity of lane dressing upon each activation. Each pump can be calibrated in order to predetermine the quantity of lane dressing discharged upon each activation.

Continuing with the example concerning pump P1, when discharge head 80*a* reaches that area of the transfer section corresponding to board 3, RDM contact 3 is enabled. Since slightly more lane dressing is desired for board 3, RDM contact 3 may be programmed to be closed for a total of two counts occuring between the eleventh and twentieth pulses received at terminal IN of counter RDM. For example, contact RDM 3 may be programmed to close in response to the reception of the fourteenth and fifteenth counts at terminal IN. If this is the case, RDM contact 3 is closed for a span of two counts and contact T0 activates relay 31 twice in succession. This in turn activates relay 33 twice which in turn activates controller output 020 twice in succession to produce two corresponding activations of pump P1 for discharge of two dressing quantities onto reception roller 124.

As can be appreciated, the placement of the discharges can be controlled by selecting the appropriate pulse counts. For example, in the case of board 3, selection of pulse counts 19 and 20 would deliver the two lane dressing quantities near the inboard side of board 3 rather than the outboard side thereof. Thus, the numerical programming of counter RDM determines both the number of quantities of lane dressing to be delivered and their placement.

The operation of pump P2 is controlled by RDM contacts 11–20 which activate relay 35 which in turn activates coil 37 through closed contacts KR0 and 35. Activation of coil 37 in turn activates controller output 021 for pump P2.

RDM contacts 11–20 also control activation of relay relay 39 which in turn activates relay 41 for activating output 022 corresponding to pump P3.

As discussed above, RDM contacts 2–10 also enable relay 45 which in turn activates relay 47 in order to activate output 023 for pump P4.

As will be appreciated, pumps P1–4 are controlled independently as discharge heads 80*a–d* traverse their respective transfer sections. In this way, all of the transfer sections receive their predetermined quantities of lane dressing during the same nineteen second interval.

Activation of coil KR0 also enables counter C0 to receive input pulses via normally closed contact KR1 and timer contact T0. At a count corresponding to nineteen seconds (95 counts) counter C0 is activated and thereby deactivates head motor forward output 013 by opening normally closed contact C0.

Relay CR4 is energized when controller output 014 sinks current which is normally active through normally closed contact KR2 and head position switch HPS. Thus, relay CR4 is energized thereby closing corresponding contact CR4 so that head motor 104 immediately reverses when relay CR3 is deenergized.

When counter CO is activated at nineteen seconds, it activates timer T2 to provide a two second delay before activating output 017 which in turn sinks current to energize relay CR7 and thereby transfer motor 120. With transfer motor 120 energized, reception roller 124, transfer roller 130, distribution roller 132 begin to rotate in order to distribute lane dressing along the length of the respective transfer sections thereof. Timer T2 also activates timer T3 which provides a five second delay to allow time for the lane dressing to distribute. This five second delay is chosen as sufficient for distribution among the respective transfer sections but short enough to prevent lane dressing from distributing to any significant degree between transfer sections.

After five seconds, timer T3 is activated which activates relay 49 and controller output 016. This output sinks current to energize relay CR6 which in turns sets drive motor 62 for forward rotation. Coil 49 in turn activates controller output 015 in order to energize drive motor relay CR5 which energizes drive motor 62. At this point, apparatus 10 begins forward motion.

Coil 49 also activates timer T4 which provides a 0.3 second delay before buffer motor 136 is energized after which timer T4 activates controller output 012 which energizes buffer motor relay coil CR2. This in turn energizes buffer motor relay BMR which energizes buffer motor 136 through circuit breaker B2. Buffer motor 136 is the largest of the motors and needs a relay with heavy duty contacts—hence, the provision of buffer motor relay BMR.

Activation of coil T3 also activates relay 51 which in turn activates distance forward counter C1. This counter determines the distance apparatus 10 moves forwardly along lane 150 in accordance with the predetermined pulse count corresponding to the desired travel distance of apparatus 10. When this count is reached, counter C1 activates timers T5 and T6 and also opens its associated normally closed contact to deactivate relays 49 and controller output 016. This deactivates drive control output 015 in order to deenergize drive motor 62. When timer T5 reaches 0.8 seconds, it deenergizes output 012 which in turn deactivates CR2. This deenergizes relay BMR to deenergize buffer motor 136 which provides braking action for apparatus 10.

After timer T6 times for five seconds, associated normally open contact T6 closes in order to activate relay 49 which in turn activates controller output 015 to again energize drive motor 62, but this time in the reverse direction because output 016 is inactive. Activation of timer T6 also activates distance reverse counter C2 through closed contact feed 51 which was closed when timer T3 was activated. Relay 49 again activates timer T4. After a 0.3 second delay, timer T4 activates output 012 which energizes relays CR2 and BMR to again energize buffer motor 136. Distance reverse C2 is set for the same count as distance forward counter C1 in order to return apparatus 10 back to the starting point at the foul line of bowling lane 150.

When counter C2 reaches a predetermined count, it closes an associated contact which resets relay KR0 (FIG. 9*a*) which in turn resets all of the relays, timers, counters, and outputs to their start condition. Apparatus 10 can then be shifted to the next lane and the process reinitiated.

Figure 10:
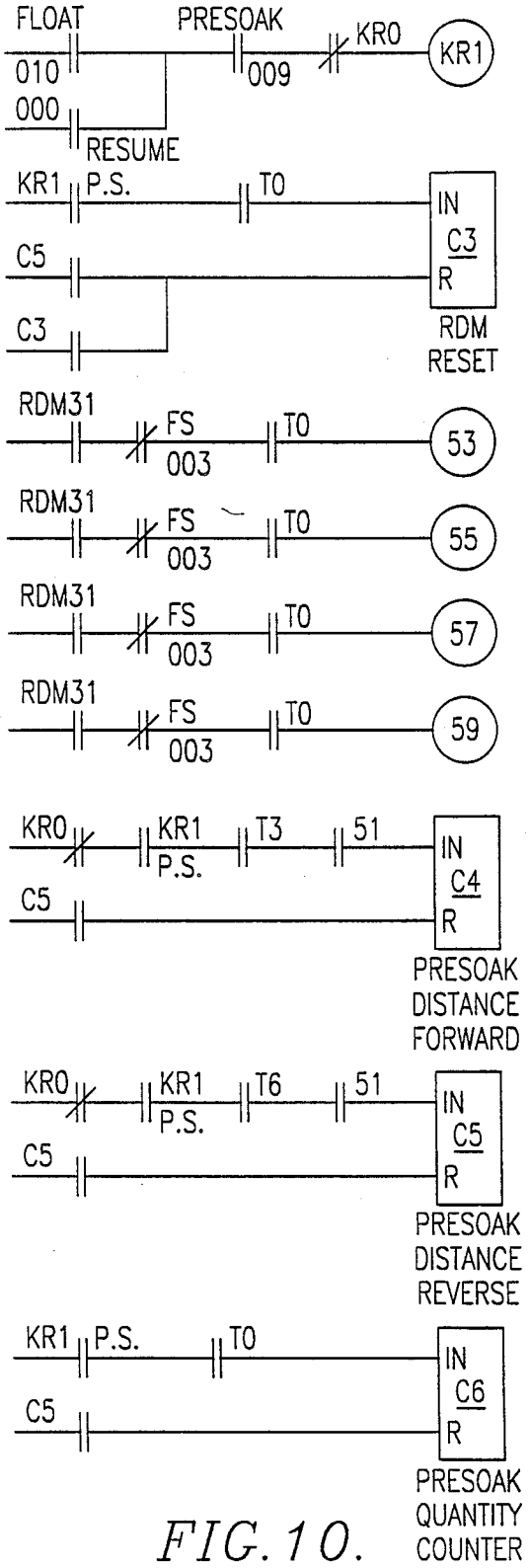
FIG. 10 is a ladder diagram illustrating the PRESOAK submodule of the operating program.
Figure 11:
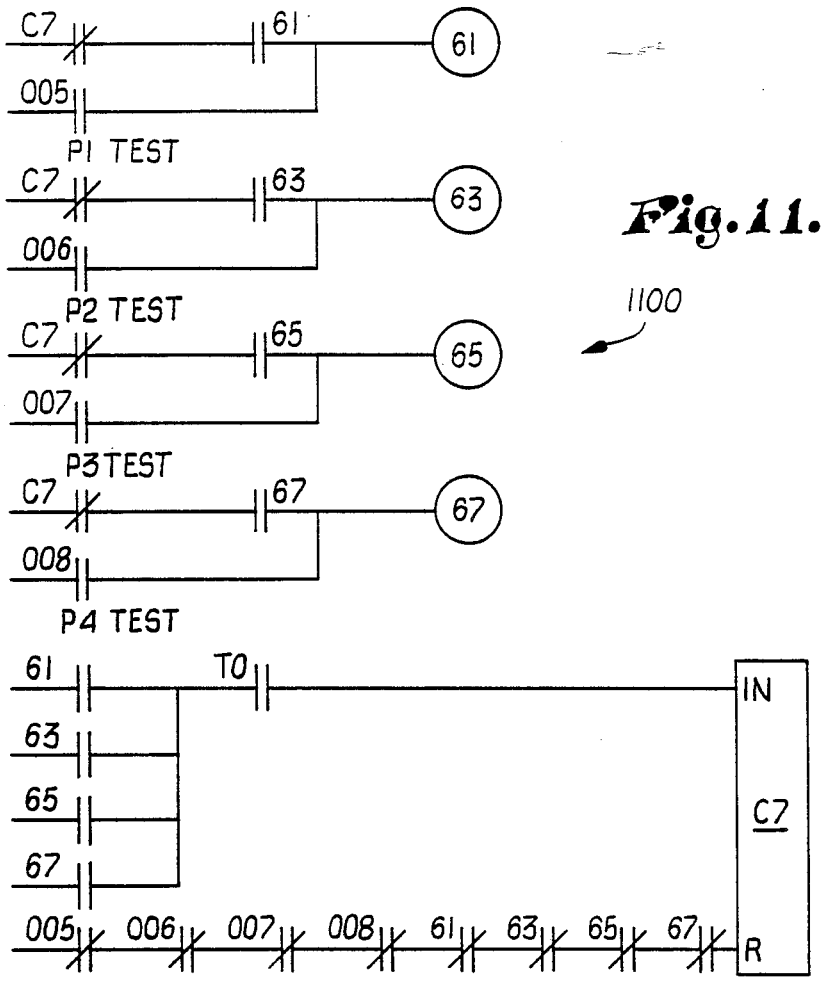
FIG. 11 is a ladder diagram illustrating the PUMP CALIBRATION submodule of the operating program.
Figure 12:
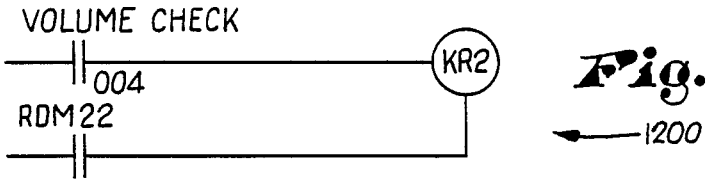
FIG. 12 is a ladder diagram illustrating the VOLUME CHECK submodule of the operating program.
Figure 13:
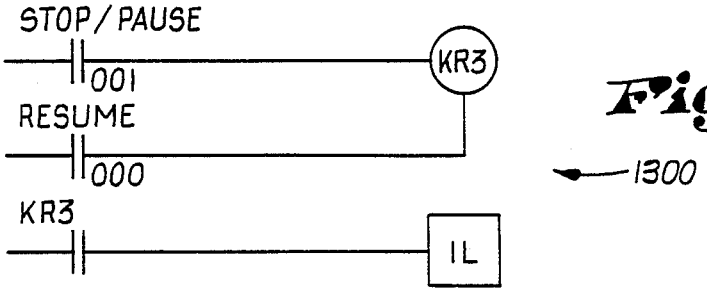
FIG. 13 is a ladder diagram illustrating the STOP/-PAUSE submodule of the operating program.

As those skilled in the art will appreciate, if apparatus 10 sits for any significant length of time, overnight for example, lane dressing on the surfaces of buffer bristles 144 tend to migrate along the length thereof. Additionally, the lane dressing tends to thicken preventing its application to bowling lane surface 152. PRESOAK subroutine 1000 is provided as illustrated in FIG. 10 in order to furnish an initial "constant" amount of lane dressing on the various contact surfaces of apparatus 10. This subroutine is initiated by the operator of apparatus 10 before lane dressing application to the first bowling lane.

Subroutine 1000 is initiated by activating PRESOAK switch PB9 which activates relay KR1. This in turn activates controller output 013 to energize head motor 104 in the forward direction (FIG. 9*a*) and activates timers T0 and T1. Relay KR1 also activates counter RDM. Counter C3 resets RDM every 10 counts (one board) so that RDM 31 is set for one, two, or three pumps in the middle of each board.

Relay KR1 also enables counter C6 to count pulses through timer contact TO.

RDM contact 31 enables timer contact T0 to activate relays 53, 55, 57 and 59. This in turn activates relays 33, 37, 41, and 47 respectively in order to provide the predetermined number of pump discharges from pumps P1–P4.

The operation of apparatus 10 then proceeds as described above in connection with RUN subroutine 900 (FIGS. 9A, B) but with distance forward determined in accordance with PRESOAK distance forward counter C4. Counters C1 and C2 (FIG. 9B) are locked out by opening of normally closed contacts KR1.

After the predetermined PRESOAK distance forward which is typically much less than the normal RUN distance, apparatus 10 reverses for a distance determined by PRESOAK distance reverse counter C5 until apparatus 10 is returned to the bowling lane foul line.

At the predetermined count, counter C5 resets counter C6 which deactivates relays 33 and 47.

PUMP CALIBRATION is subroutine 1100 (FIG. 11) allows manual activation of a selected pump P1–4 in order to measure a predetermined number of discharge quantities therefrom for calibration purposes. In using this subroutine, a discharge pencil 90 is removed from the associated discharge head 80*a–d* of the respective pump P1–4 to be tested. In order to check the calibration of pump P1, for example, P1 test switch PB5 is depressed which activates relay 61. This in turn activates timer T0, relay 31, and relay 33 (FIG. 9*a*). Activation of relay 61 also activates calibration counter C7. With relay 61 energized, relays 31 and 33 are energized with each activation of timer T0 which produces corresponding activations of P1 which continue until the count on counter C7 is reached. When this occurs, an associated normally closed contact opens thereby deactivating relay 61 which in turn deactivates timer T0 and relay 31. Deactivation of relay 61 also resets counter C7.

The operator then observes the amount of lane dressing in graduated cylinder 116 associated with pump P1. Counter C7 provides sufficient activations of the associated pump in order to provide an accurate measurement of a plurality of lane dressing quantities since an individual quantity is typically a very small amount.

Respective activations pump switches PB6, PB7, and PB8 respectively activate relay 63, 65, or 67 in order to calibrate pumps P2, P3, or P4 as selected.

As discussed above, counter RDM is programmed to deliver a predetermined number of lane dressing quantities in order to produce the desired lane dressing profile as exemplified in FIG. 7. VOLUME CHECK subroutine 1200 (FIG. 12) allows the programmed volume of lane dressing to be checked, that is measured, in associated graduates 116. This ensures that apparatus 10 provides the desired precise, predetermined, discrete quantities of lane dressing.

Before initiating subroutine 1200, the operator removes all of pencils 90 and places them in their respective graduate cylinders 116 and then the operator activates volume check switch PB4 which activates relay KR2. This in turn activates the various timers, counters, and relays to simulate normal run activation of pumps P1–4 but without energizing any of the output motors.

Figure 9B:
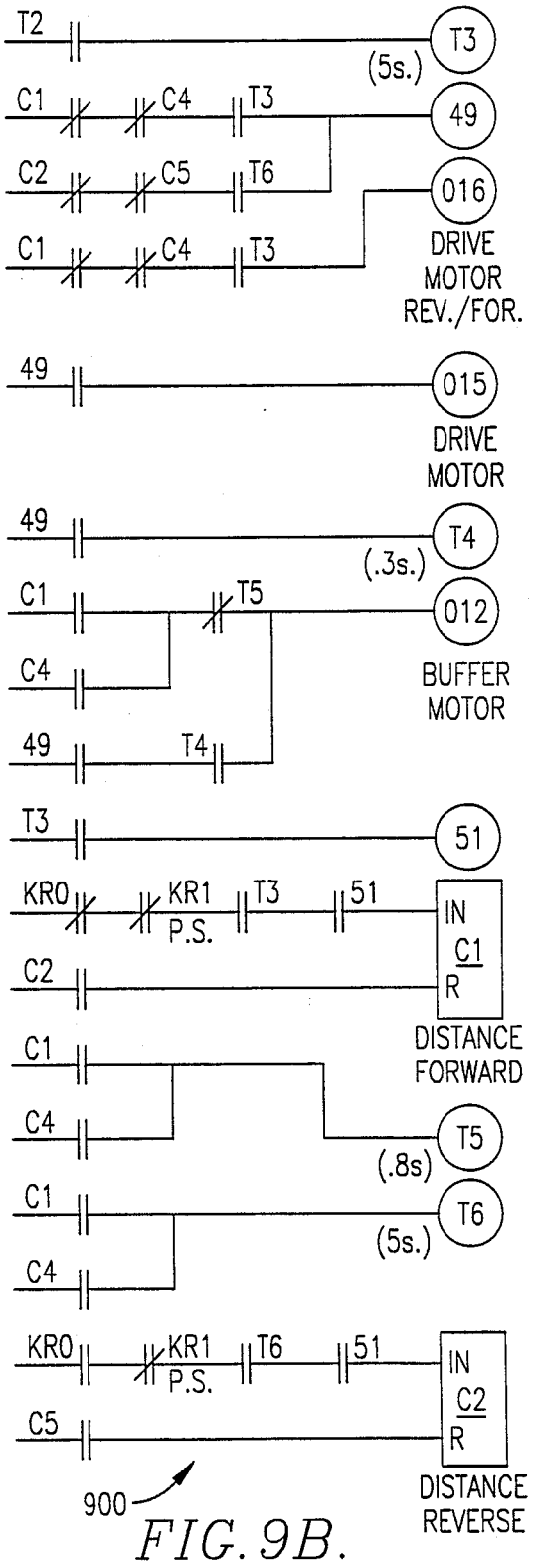
FIG. 9B is a ladder diagram illustrating the remaining portion of the RUN submodule of FIG. 9A.

Referring to FIGS. 9*a* and 9*b*, activation of relay KR2 activates timer T0, counter RDM, and enables relays 33, 37, 41, and 47 for energizing pumps P1–P4 according to the normal program set on counter RDM. At the end of operation, contact RDM 22 resets relay KR2. The operator can then measure the amounts in respective graduated cylinders 116 in order to determine that the desired programmed amounts of lane dressing are being produced during operation.

STOP/PAUSE subroutine 1300 (FIG. 13) allows the operator to put the program on hold, that is to stop all motors and hold the operation in abeyance. This may be desired if an obstruction is observed on the bowling lane, for example. The operator initites subroutine 1300 by activating STOP/PAUSE switch PB2, which activates relay KR3, which in turn deactivates relay IL to stop execution of the program. In order to resume program execution, the operator activates resume switch PB3 which in turn resets relay KR3 and reactivates relay IL.

Having thus described the preferred embodiment of the present invention, the following is claimed as new and desired to be secured by Letters Patent:

1. In combination with an apparatus for applying lane dressing to the surface of a bowling lane, the apparatus including a reservoir for storing a supply of lane dressing and means for propelling the apparatus along the bowling lane, the improvement comprising:

applicator means for receiving lane dressing from a source thereof and for applying lane dressing so received to the lane surface as the apparatus is propelled therealong;

said applicator means including means for receiving and applying the lane dressing in discrete, side-by-side treatment zones of the bowling lane;

lane dressing delivery means for delivering lane dressing to said applicator means, said delivery means including activatable metering means coupled with the reservoir for receiving lane dressing therefrom and for discharging a discrete, predetermined quantity of lane dressing upon each activation for delivery to said applicator means; and control means coupled with said metering means for selective activation thereof.

2. In combination with an apparatus for applying lane dressing to the surface of a bowling lane, the apparatus including a reservoir for storing a supply of lane dressing and means for propelling the apparatus along the bowling lane, the improvement comprising:

applicator means for receiving lane dressing from a source thereof and for applying lane dressing so received to the lane surface as the apparatus is propelled therealong;

lane dressing delivery means for delivering lane dressing to said applicator means, said delivery means including activatable metering means coupled with the reservoir for receiving lane dressing therefrom and for discharging a discrete, predetermined quantity of lane dressing upon each activating for delivery to said applicator means; and control means coupled with said metering means for selective activation thereof, the bowling lane surface presenting a plurality of elongated treatment zones, said applicator means including a plurality of applicator portions respectively corresponding to said treatment zones for applying lane dressing thereto as the apparatus is propelled along the bowling lane, said delivery means including means for delivering said quantity to a selected ones of said portions.

3. The improvement as set forth in claim 2, said delivery means further including transfer means for receiving said lane dressing quantity from said metering means and for transferring said quantity to said applicator means, said transfer means including a plurality of transfer sections respectively corresponding to said applicator portions and in lane dressing transfer relationship therewith for transferring said lane dressing quantity to a selected one of said applicator portions, said metering means being shiftable relative to at least one of said transfer sections, said delivery means including means for shifting said metering means in order to deliver said lane dressing quantity to a selected area of a selected one of said transfer sections.

4. The improvement as set forth in claim 3, said delivery means including a plurality of said metering means respectively corresponding to said transfer sections.

5. The improvement as set forth in claim 3, said transfer means including a reception roller for receiving said lane dressing quantity, and a transfer roller rotatably engaged with said reception roller and in dressing-transfer relationship therewith and with said applicator means for receiving said lane dressing quantity from said reception roller during mutual rotation thereof and for transferring said quantity to said applicator means.

6. The improvement as set forth in claim 3, said control means including programmable means including memory means for storing an operating program for activating said metering means and for shifting said metering means in accordance with said program.

7. The improvement as set forth in claim 5, said transfer means further including a distribution roller rotatably engaged with said reception roller for exchanging said lane dressing quantity therebetween during mutual rotation thereof for distributing said lane dressing quantity along the associated transfer section.

8. The improvement as set forth in claim 5, said reception roller including a dressing absorbent covering thereon.

9. The improvement as set forth in claim 2, said control means including memory means for storing information representative of a desired number of lane dressing quantities to be applied to a selected one of said treatment zones corresponding to a selected one of said applicator portions, and means for responsive to said information for activating said metering means in accordance therewith.

10. The improvement as set forth in claim 9, said memory means being selectively alterable.

11. In combination with an apparatus for applying lane dressing to the surface of a bowling lane, the apparatus including a reservoir for storing a supply of lane dressing and means for propelling the apparatus along the bowling lane, the improvement comprising:

applicator means for receiving lane dressing from a source thereof and for applying lane dressing so received to the lane surface as the apparatus is propelled therealong;

lane dressing delivery means for delivery lane dressing to said applicator means, said delivery means including activatable metering means coupled with the reservoir for receiving lane dressing therefrom and for discharging a discrete, predetermined quantity of lane dressing upon each activation for delivery to said applicator means; and control means coupled with said metering means for selective activation thereof, said applicator means including a rotatable applicator buffer roller having a plurality of outwardly extending, flexible applicator members coupled therewith for receiving lane dressing thereon and for engaging the lane surface in order to apply the lane dressing thereto during rotation of said buffer roller.

12. In combination with an apparatus for applying lane dressing to the surface of a bowling lane, the apparatus including a reservoir for storing a supply of lane dressing and means for propelling the apparatus along the bowling lane, the improvement comprising:

applicator means for receiving lane dressing from a source thereof and for applying lane dressing so received to the lane surface as the apparatus is propelled therealong;

lane dressing delivery means for delivering lane dressing to said applicator means, said delivery means including activatable metering means coupled with the reservoir for receiving lane dressing therefrom and for discharging a discrete, predetermined quantity of lane dressing upon each activation for delivery to said applicator means; and control means coupled with said metering means for selective activation thereof, said control means including memory means for storing information representative of the desired amount of lane dressing to be applied to the lane surface and means responsive to said information for activating said metering means in accordance therewith.

13. In combination with an apparatus for applying lane dressing to the surface of a bowling lane, the apparatus including a reservoir for storing a supply of lane dressing and means for propelling the apparatus along the bowling lane, the improvement comprising:

applicator means for receiving lane dressing from a source thereof and for applying lane dressing so received to the lane surface as the apparatus is propelled therealong;

lane dressing delivery means for delivering lane dressing to said applicator means, said delivery means including activatable metering means coupled with the reservoir for receiving lane dressing therefrom and for discharging a discrete, predetermined quantity of lane dressing upon each activation for delivery to said applicator means; and control means coupled with said metering means for selective activation thereof, said controller means including a programmable controller.

14. In combination with an apparatus for applying lane dressing to the surface of a bowling lane, the apparatus including a reservoir for storing a supply of lane dressing and means for propelling the apparatus along the bowling lane, the improvement comprising:

applicator means for receiving lane dressing from a source thereof and for applying lane dressing so received to the lane surface as the apparatus is propelled therealong;

lane dressing delivery means for delivery lane dressing to said applicator means, said delivery means including activatable metering means coupled with the reservoir for receiving lane dressing therefrom and for discharging a discrete, predetermined quantity of lane dressing upon each activation for delivery to said applicator means; and control means coupled with said metering means for selective activation thereof, said metering means being operable for discharging a plurality of said quantities upon a respective plurality of activations.

15. In combination with an apparatus for applying lane dressing to the surface of a bowling lane, the apparatus including a reservoir for storing a supply of lane dressing and means for propelling the apparatus along the bowling lane, the improvement comprising:

applicator means for receiving lane dressing from a source thereof and for applying lane dressing so received to the lane surface as the apparatus is propelled therealong;

lane dressing delivery means for delivering lane dressing to said applicator means, said delivery means including activatable metering means coupled with the reservoir for receiving lane dressing therefrom and for discharging a discrete, predetermined quantity of lane dressing upon each activation for delivery to said applicator means; and control means coupled with said metering means for selective activation thereof, further including means for calibrating said metering means.

* * * * *

US004980815B1

REEXAMINATION CERTIFICATE (2867th)

United States Patent [19] [11] B1 4,980,815

Davis [45] Certificate Issued May 7, 1996

[54] APPARATUS FOR APPLYING LANE DRESSING TO A BOWLING LANE

[75] Inventor: John M. Davis, Sebring, Fla.

[73] Assignee: The Kegel Company, Inc., Sebring, Fla.

Reexamination Request:
No. 90/003,491, Jul. 6, 1994

Reexamination Certificate for:
Patent No.: 4,980,815
Issued: Dec. 25, 1990
Appl. No.: 280,374
Filed: Dec. 6, 1988

[51] Int. Cl.[6] ..... G05B 19/05; A47L 13/30
[52] U.S. Cl. ..... 364/140; 364/147; 364/479; 15/49.1; 134/56 R
[58] Field of Search ..... 364/479, 140, 364/147; 15/51, 98, 49 R, 49.1, 21.1; 134/56 R, 132, 133

[56] References Cited

U.S. PATENT DOCUMENTS

| | | | |
|---|---|---|---|
| 3,216,036 | 11/1965 | Rockwood et al. | 15/98 |
| 3,216,037 | 11/1965 | Stevens et al. | 15/98 |
| 3,217,347 | 11/1965 | Domecki | 15/51 |
| 3,321,331 | 5/1967 | McNeely | 134/6 |
| 4,114,711 | 9/1978 | Wilkins | 180/6.5 |
| 4,700,427 | 10/1987 | Knepper | 15/319 |
| 4,766,016 | 8/1988 | Kubo | 427/428 |

OTHER PUBLICATIONS

Shuttle 2000 Lane Maintenance Manual, Wippon Brunswick Co., Ltd. (Date Unknown).

*Primary Examiner*—Paul Gordon

[57] ABSTRACT

An improved apparatus for applying lane dressing to bowling lane surfaces is provided which precisely controls the desired quantity and distribution of lane dressing applied to selective treatment zones presented by the bowling lane surface. The preferred apparatus includes a pluraltiy of activatable metering pumps which discharge discrete, predetermined quantities of lane dressing to a transfer machanism. The transfer mechanism distributes and transfers the lane dressing quantities to selected portions of an applicator buffer roller which in turn applies the lane dressing quantities to corresponding bowling lane treatment zones.

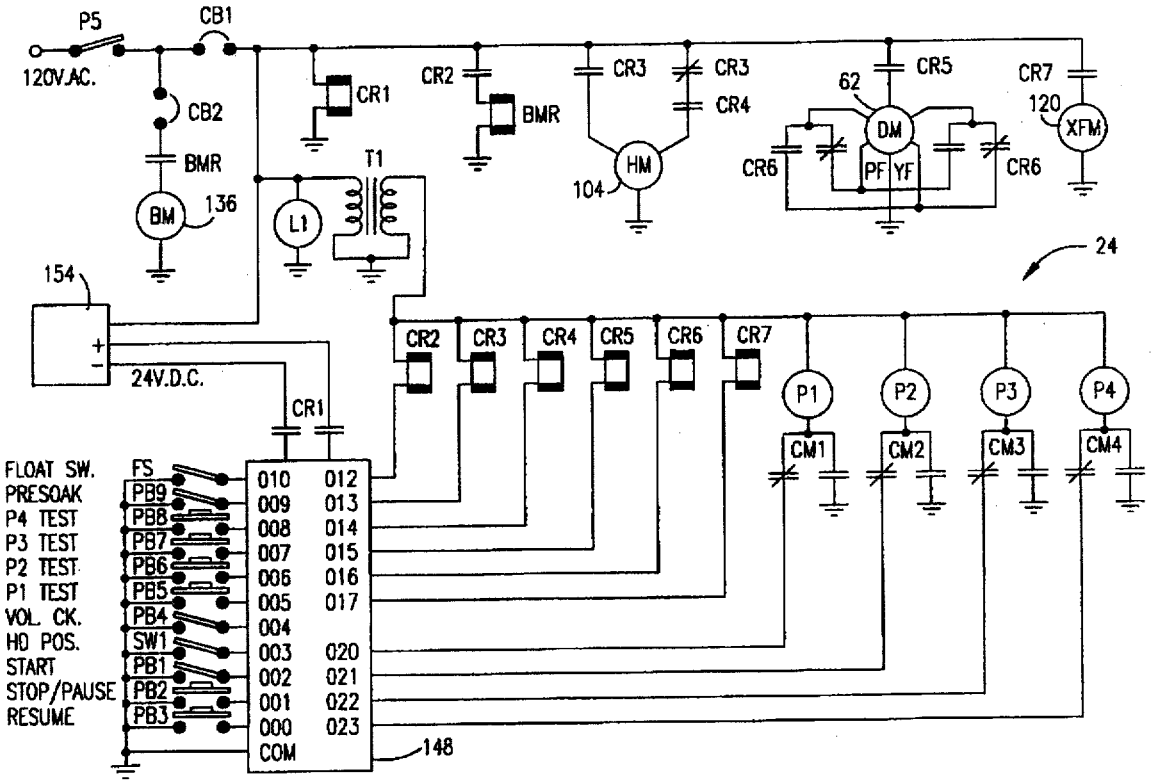

REEXAMINATION CERTIFICATE ISSUED UNDER 35 U.S.C. 307

THE PATENT IS HEREBY AMENDED AS INDICATED BELOW.

Matter enclosed in heave brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 11–14 are cancelled.

Claims 1–3, 15 are determined to be patentable as amended.

Claims 4–10, dependent on an amended claim, are determined to be patentable.

New claims 16–55 are added and determined to be patentable.

1. In combination with an apparatus for applying lane dressing to the surface of a bowling lane, the apparatus including a reservoir for storing a supply of lane dressing and means for propelling the apparatus along the bowling lane, the improvement comprising:

applicator means for receiving lane dressing from a source thereof and for applying lane dressing so received to the lane surface as the apparatus is propelled therealong;

said applicator means including means for receiving and applying the lane dressing in discrete, side-by-side treatment zones of the bowling lane;

lane dressing delivery means for delivering lane dressing to said applicator means, said delivery means including activatable metering means coupled with the reservoir for receiving lane dressing therefrom and for discharging a discrete, predetermined quantity of lane dressing upon each activation for delivery to said applicator means; and control means coupled with said metering means for selective activation thereof [.],

*said delivery means including a plurality of said metering means and a corresponding plurality of discharge outlets respectively coupled with said metering means for receiving lane dressing therefrom and for discharging lane dressing onto said applicator means at locations corresponding to said zones,*

*said control means including means for activating each of said metering means independently of the activation of the others of said metering means and for selectively activating each of said metering means a plurality of times for discharging a corresponding plurality of said quantities during a single traversal of said apparatus along the lane.*

2. In combination with an apparatus for applying lane dressing to the surface of a bowling lane, the apparatus including a reservoir for storing a supply of lane dressing and means for propelling the apparatus along the bowling lane, the improvement comprising:

applicator means for receiving lane dressing from a source thereof and for applying lane dressing so received to the lane surface as the apparatus is propelled therealong;

said applicator means including means for receiving and applying the lane dressing in discrete, side-by-side treatment zones of the bowling lane;

lane dressing delivery means for delivering lane dressing to said applicator means, said delivery means including activatable metering means coupled with the reservoir for receiving lane dressing therefrom and for discharging a discrete, predetermined quantity of lane dressing upon each [activating] *activation* for delivery to said applicator means; and control means coupled with said metering means for selective activation thereof, the bowling lane surface presenting a plurality of elongated treatment zones, said applicator means including a plurality of applicator portions respectively corresponding to said treatment zones for applying lane dressing thereto as the apparatus is propelled along the bowling lane, said delivery means including means for delivering said quantity to a selected ones of said portions,

*said delivery means including an oulet structure defining a lane dressing outlet located for discharing lane dressing onto said applicator means,*

*said apparatus presenting a direction of travel when being propelled along a bowling lane, said applicator means presenting an axis transverse to said direction of travel,*

*said delivery means including activatable shifting means for selectively shifting said outlet structure parallel to said applicator means axis while said apparatus is propelled along a bowling lane,*

*said control means including means for selectively activating said metering means and for selectively activating said shifting means in coordination with one another for discharging a plurality of said quantities from said outlet at predetermined locations on said applicator means.*

3. The improvement as set forth in claim 2, said delivery means further including transfer means for receiving said lane dressing quantity from said metering means and for transferring said quantity to said applicator means, said transfer means including a plurality of transfer sections respectively corresponding to said applicator portions and in lane dressing transfer relationship therewith for transferring said lane dressing quantity to a selected one of said applicator portions[, said metering means being shiftable relative to at least one of said transfer sections, said delivery means including means for shifting said metering means in order to deliver said lane dressing quantity to a selected area of a selected one of said transfer sections].

15. In combination with an apparatus for applying lane dressing to the surface of a bowling lane, the apparatus including a reservoir for storing a supply of lane dressing and means for propelling the apparatus along the bowling lane, the improvement comprising:

applicator means for receiving lane dressing from a source thereof and for applying lane dressing so received to the lane surface as the apparatus is propelled therelong;

lane dressing delivery means for delivering lane dressing to said applicator means, said delivery means including activatable metering means coupled with the reservoir for receiving lane dressing therefrom and for discharging a discrete, predetermined quantity of lane dressing upon each activation for delivery to said applicator means; and control means coupled with said metering means for selective activation thereof, further including means for calibrating said metering means[.],

*said control means being operable for activating said metering means a predetermined number of times for discharging a corresponding plurality of said quantities,*

*said means for calibrating including means for receiving and containing said plurality of said quantities from said metering means in place of said applicator means and for measuring said plurality of said quantities.*

*16. The improvement as set forth in claim 1, said metering means including a lane dressing discharge outlet, said delivery means including means for selectively shifting said outlet relative to said applicator means during discharge of lane dressing from said outlet.*

*17. The improvement as set forth in claim 1, the bowling lane including a plurality of side-by-side boards, said delivery means including discharge structure selectively operable for discharging predetermined, discrete quantities of lane dressing onto said applicator means at locations thereof corresponding respectively to the bowling lane boards.*

*18. The improvement as set forth in claim 1, the bowling lane inlcuding a plurality of side-by-side boards,*

*said treatment zones corresponding to the bowling lane boards,*

*said delivery means including means for delivering lane dressing to said applicator means at locations thereon respectively corresponding to the bowling lane boards,*

*said control means being operable for selecting the number of said quantities of lane dressing for application to each of the bowling lane boards and for selectively activating said metering means for delivering said number of quantities to said applicator means at said corresponding locations.*

*19. The improvement as set forth in claim 1, said control means including a programmable controller.*

*20. The improvement as set forth in claim 1, said metering means including a plurality of metering pumps respectively coupled with said discharge structures.*

*21. The improvement as set forth in claim 20, each of said discharge structures being operable for discharging a plurality of said quantities.*

*22. The improvement as set forth in claim 1, said applicator means including a rotatable buffer roller, said delivery means further including transfer means for receiving lane dressing from said outlets and for distributing lane dressing so received about the periphery of said buffer roller.*

*23. The improvement as set forth in claim 22, said transfer means including a transfer roller rotatably engaged with said buffer roller.*

*24. The improvement as set forth in claim 23, said transfer means further including a reception roller for receiving lane dressing from said outlets and rotatably engaged with said transfer roller.*

*25. The improvement as set forth in claim 2, said control means including a programmable controller.*

*26. The improvement as set forth in claim 2, said metering means including a plurality of said discharge outlets.*

*27. The improvement as set forth in claim 26, said metering means including a plurality of metering pumps respectively corresponding to said outlets and respectively coupled therewith, said outlets corresponding to said treatment zones.*

*28. The improvement as set forth in claim 2, the bowling lane including a plurality of side-by-side boards,*

*said treatment zones corresponding to the bowling lane boards,*

*said delivery means including means for delivering lane dressing to said applicator means at locations thereon respectively corresponding to the bowling lane boards,*

*said control means being operable for selecting the number of said quantites of lane dressing for application to each of the bowling lane boards and for selectively activating said metering means for delivering said number of quantities to said applicator means at said corresponding locations.*

*29. The improvement as set forth in claim 2, said delivery means including a plurality of said outlet structures.*

*30. The improvement as set forth in claim 15, said means for measuring including a graduated cylinder, said metering means including means for discharging said selected plurality of said quantities into said graduated cylinder.*

*31. In combination with an apparatus for applying lane dressing to the surface of a bowling lane, the apparatus including a reservoir for storing a supply of lane dressing and means for propelling the apparatus along the bowling lane, the improvement comprising:*

*applicator means for receiving lane dressing from a source thereof and for applying lane dressing so received to the lane surface as the apparatus is propelled therealong;*

*said applicator means including means for receiving and applying the lane dressing in discrete, side-by-side treatment zones of the bowling lane;*

*lane dressing delivery means for delivering lane dressing to said applicator means, said delivery means including activatable metering means coupled with the reservoir for receiving lane dressing therefrom and for discharging a discrete, predetermined quantity of lane dressing upon each activation for delivery to said applicator means; and*

*control means coupled with said metering means for selective activation thereof,*

*the bowling lane including a plurality of side-by-side boards,*

*said delivery means including discharge structure selectively operable for discharging discrete, predetermined quantities of lane dressing onto said applicator means at locations thereof corresponding respectively to the bowling lane boards,*

*said delivery means further including transfer means for receiving said lane dressing quantity from said metering means and for transferring said quantity to said applicator means, said transfer means including a plurality of transfer sections respectively corresponding to said applicator portions and in lane dressing transfer relationship therewith for transferring said lane dressing quantity to a selected one of said applicator portions,*

*said delivery means including a plurality of said metering means respectively corresponding to said transfer sections,*

*said transfer means including a reception roller for receiving said lane dressing quantity, and*

*a transfer roller rotatably engaged with said reception roller and in dressing-transfer relationship therewith and with said applicator means for receiving said lane dressing quantity from said reception roller during mutual rotation thereof and for transferring said quantity to said applicator means,*

*said applicator means including a rotatable applicator buffer roller having a plurality of outwardly extending, flexible applicator members coupled therewith for receiving lane dressing thereon and for engaging the lane surface in order to apply the lane dressing thereto during rotation of said buffer roller.*

*32. In combination with an apparatus for applying lane dressing to the surface of a bowling lane, the apparatus including a reservoir for storing a supply of lane dressing and means for propelling the apparatus along the bowling lane, the improvement comprising:*

*applicator means for receiving lane dressing from a source thereof and for applying lane dressing so received to the lane surface as the apparatus is propelled therealong;*

*said applicator means including means for receiving and applying the lane dressing in discrete, side-by-side treatment zones of the bowling lane;*

*lane dressing delivery means for delivering lane dressing to said applicator means, said delivery means including activatable metering means coupled with the reservoir for receiving lane dressing therefrom and for discharging a discrete, predetermined quantity of lane dressing upon each activation for delivery to said applicator means; and*

*control means coupled with said metering means for selective activation thereof,*

*said delivery means including a plurality of discharge structures with each of said structures including a lane dressing outlet and being operable independently of the others of said structures for selectively discharging said discrete, predetermined quantity of lane dressing from said outlet onto said applicator means at a predetermined location thereon,*

*said delivery means further including transfer means for receiving said lane dressing quantity from said metering means and for transferring said quantity to said applicator means, said transfer means including a plurality of transfer sections respectively corresponding to said applicator portions and in lane dressing transfer relationship therewith for transferring said lane dressing quantity to a selected one of said applicator portions,*

*said delivery means including a plurality of said metering means respectively corresponding to said transfer sections,*

*said transfer means including*

*a reception roller for receiving said lane dressing quantity, and*

*a transfer roller rotatably engaged with said reception roller and in dressing-transfer relationship therewith and with said applicator means for receiving said lane dressing quantity from said reception roller during mutual rotation thereof and for transferring said quantity to said applicator means,*

*said applicator means including a rotatable applicator buffer roller having a plurality of outwardly extending, flexible applicator members coupled therewith for receiving lane dressing thereon and for engaging the lane surface in order to apply to the lane dressing thereto during rotation of said buffer roller.*

*33. In combination with an apparatus for applying lane dressing to the surface of a bowling lane, the apparatus including a reservoir for storing a supply of lane dressing and means for propelling the apparatus along the bowling lane, the improvement comprising:*

*applicator means for receiving lane dressing from a source thereof and for applying lane dressing so received to the lane surface as the apparatus is propelled therealong;*

*said applicator means including means for receiving and applying the lane dressing in discrete, side-by-side treatment zones of the bowling lane;*

*lane dressing delivery means for delivering lane dressing to said applicator means, said delivery means including activatable metering means coupled with the reservoir for receiving lane dressing therefrom and for discharging a discrete, predetermined quantity of lane dressing upon each activation for delivery to said applicator means; and*

*control means coupled with said metering means for selective activation thereof,*

*said metering means including a lane dressing discharge outlet, said delivery means including means for selectively shifting said outlet relative to said applicator means during discharge of lane dresssing from said outlet,*

*said delivery means further including transfer means for receiving said lane dressing quantity from said metering means and for transferring said quantity to said applicator means, said transfer means including a plurality of transfer sections respectively corresponding to said applicator portions and in lane dressing transfer relationship therewith for transferring said lane dressing quantity to a selected one of said applicator portions,*

*said delivery means including a plurality of said metering means respectively corresponding to said transfer sections,*

*said transfer means including*

*a reception roller for receiving said lane dressing quantity, and*

*a transfer roller rotatably engaged with said reception roller and in dressing-transfer relatioship therewith and with said applicator means for receiving said lane dressing quantity from said reception roller during mutual rotation thereof and for transferring said quanity to said applicator means,*

*said applicator means including a rotatable applicator buffer roller having a plurality of outwardly extending, flexible applicator members coupled therewith for receiving lane dressing thereon and for engaging the lane surface in order to apply the lane dressing thereto during rotation of said buffer roller.*

*34. In combination with an apparatus for applying lane dressing to the surface of a bowling lane, the apparatus including a reservoir for storing a supply of lane dressing and means for propelling the apparatus along the bowling lane, the improvement comprising:*

*applicator means for receiving lane dressing from a source thereof and for applying lane dressing so received to the lane surface as the apparatus is propelled therealong;*

*said applicator means including means for receiving and applying the lane dressing in discrrte, side-by-side treatment zones of the bowling lane;*

*lane dressing delivery means for delivering lane dressing to said applicator means, said delivery means including activatable metering means coupled with the reservoir for receiving lane dressing therefrom and for discharging a discrete, predetermined quantity of lane dressing upon each activation for delivery to said applicator means; and*

*control means coupled with said metering means for selective activation thereof,*

*the bowling lane including a plurality of side-by-side boards,*

*said treatment zones corresponding to the bowling lane boards,*

*said delivery means including means for delivering lane dressing to said applicator means at locations thereon respectively corresponding to the bowling lane boards,*

*said control means being operable for selecting the number of said quantities of lane dressing for application to each of the bowling lane boards and for selectively activating said metering means for delivering said number of quantities to said applicator means at said corresponding locations.*

*35. The improvement as set forth in claim 34, said metering means including a lane dressing discharge outlet, said delivery means including means for selectively shifting said outlet relative to said applicator during discharge of lane dressing from said outlet, said control means including means for activating said metering means during shifting of said outlet for delivering lane dressing to said locations.*

*36. The improvement as set forth in claim 34, said delivery means including a plurality of discharge structures with each of said structures including a lane dressing outlet with each of said structures being operable independently of the others of said structures for delivering a number of said quantities of lane dressing to said applicator means at locations corresponding to the bowling lane boards.*

*37. The improvement as set forth in claim 34, said metering means including a plurality of metering pumps coupled respectively with a corresponding plurality of lane dressing discharge outelts.*

*38. The improvement as set forth in claim 34, said control means including a programmable controller.*

*39. The improvement as set forth in claim 34, said metering means including a metering pump.*

*40. The improvement as set forth in claim 34, said delivery means including a plurality of discharge outlets.*

*41. The improvement as set forth in claim 40, said delivery means including means for shifting said outlets relative to said applicator means.*

*42. The improvement as set forth in claim 34, said applicator means including a rotatable buffer roller, said delivery means further including transfer means for receiving lane dressing from said discharge structure and for distributing lane dressing so received about the periphery of said buffer roller.*

*43. In combination with an apparatus for applying lane dressing to the surface of a bowling lane, the apparatus including a reservoir for storing a supply of lane dressing and means for propelling the apparatus along the bowling lane, the improvement comprising:*

*applicator means for receiving lane dressing from a source thereof and for applying lane dressing so received to the lane surface as the apparatus is propelled therealong, said applicator means including a buffer roller;*

*said applicator means including means for receiving and applying the lane dressing in discrete, side-by-side treatment zones of the bowling lane;*

*lane dressing delivery means for delivering lane dressing to said applicator means, said delivery means including activatable metering means coupled with the reservoir for receiving lane dressing therefrom and for discharging a discrete, predetermined quantity of lane dressing upon each activation for delivery to said applicator means; and*

*control means coupled wiht said metering means for selective activation thereof,* the bowling lane including a plurality of side-*by-side boards corresponding respectively to said treatment zones,*

*said delivery means including discharge structure selectively operable for discharging discrete, predetermined quantities of lane dressing onto said buffer roller at individual locations thereof corresponding respectively to the bowling lane boards.*

*44. The improvement as set forth in claim 43; said metering means including a metering pump.*

*45. The improvement as set forth in claim 43, said delivery means for shifting said discharge structure relative to said applicator means.*

*46. The improvement as set forth in claim 43, said applicator means, including a rotatable buffer roller, said delivery means further including transfer means for receiving lane dressing from said discharge structure and for distributing land dressing so received about the periphery of said buffer roller.*

*47. The improvement as set forth in claim 46, said transfer means including a transfer roller rotatably engaged with said buffer roller.*

*48. The improvement as set forth in claim 43, said control means including means for selecting the number of said quantities of lane dressing for application for each of the bowling lane boards and for selectively activating said metering means for delivering said number of quantities to said applicator means at said locations.*

*The improvement as set forth in claim 43, said control means including a programmable controller.*

*50. The improvement as set forth in claim 43, said metering means including a plurality of metering pumps.*

*51. In combination with an apparatus for applying lane dressing to the surface of a bowling lane, the apparatus including a reservoir for storing a supply of lane dressing and means for propelling the apparatus along the bowling lane, the improvement comprising:*

*applicator means for receiving lane dressing from a source thereof and for applying lane dressing so received to the lane surface as the apparatus is propelled therealong;*

*said applicator means including means for receiving and applying the lane dressing in discrete, side-by-side treatment zones extending along the length of the bowling lane;*

*lane dressing delivery means including activatable metering means for receiving lane dressing from the reservoir and for delivering lane dressing to said applicator means at locations corresponding to said zones; and*

*control means coupled with said metering means for selective activation thereof,* said applicator means including a rotatable buffer roller and lane dressing transfer means disposed between said delivery means and said buffer roller for receiving lane dressing discharged from said delivery means and for transferring land dressing so received to said buffer roller, said buffer roller and transfer means having zone locations corresponding to said zones,

*said metering means including a plurality of electrically activatable metering devices corresponding respectively to said treatment zones, each of said metering devices including an outlet and being operable, in response to each selective activation, for discharging through said outlet a discrete, predetermined quantity of lane dressing to said transfer means at a corresponding zone location,*

*said control means including electronic memory means for storing information representative of a selected lane dressing pattern for the bowling lane, said information including the number of said quantities of lane dressing for application to each of said zones and the distribution of said number quantities along the length of said zones as said apparatus is propelled along the lane for achieving said pattern,* said control means further including means for retrieving said information from said memory means and for selecively activating each of said metering devices, independently of the activation of the others of said metering devices, in accordance with said information during traversal of said apparatus along the length of the bowling lane.

*52. The improvement as set forth in claim 51, said metering devices including metering pumps.*

*53. The improvement as set forth in claim 51, said delivery means including means for shifting said outlets relative to said buffer roller.*

*54. The improvement as set forth in claim 51, said transfer means including a transfer roller rotatably engaged with said buffer roller.*

*55. The improvement as set forth in claim 54, said transfer means further including a reception roller positioned for receiving lane dressing from said outlets and rotatably engaged with said transfer roller.*

* * * * *